US010109266B1

(12) United States Patent
Buchanan

(10) Patent No.: US 10,109,266 B1
(45) Date of Patent: Oct. 23, 2018

(54) AUTOMATICALLY ADJUSTING KEYBOARD DIVIDE

(71) Applicant: Jonathan Buchanan, Douglassville, PA (US)

(72) Inventor: Jonathan Buchanan, Douglassville, PA (US)

( * ) Notice: Subject to any disclaimer, the term of this patent is extended or adjusted under 35 U.S.C. 154(b) by 0 days.

(21) Appl. No.: 15/961,778

(22) Filed: Apr. 24, 2018

(51) Int. Cl.

| | |
|---|---|
| ***G10H 1/24*** | (2006.01) |
| ***G10H 1/26*** | (2006.01) |
| ***G10H 1/18*** | (2006.01) |
| ***G10C 3/12*** | (2006.01) |
| ***G10H 1/00*** | (2006.01) |

(52) U.S. Cl.
CPC ..... *G10H 1/186* (2013.01); *G10C 3/12* (2013.01); *G10H 1/0025* (2013.01); *G10H 1/26* (2013.01); *G10H 2220/221* (2013.01)

(58) Field of Classification Search
CPC ..... G10H 1/18; G10H 1/34; G10H 2220/221; G06K 7/10722; G10C 3/08; G10G 1/00; G10D 13/085
See application file for complete search history.

(56) References Cited

U.S. PATENT DOCUMENTS

| | | | | |
|---|---|---|---|---|
| 4,960,031 | A * | 10/1990 | Farrand | G09B 15/023 84/462 |
| 5,198,605 | A * | 3/1993 | Konishi | G10H 1/053 84/658 |
| 5,322,967 | A * | 6/1994 | Matsuda | G10H 1/18 84/653 |
| 2008/0115659 | A1* | 5/2008 | Lauffer | G10H 1/0008 84/626 |
| 2009/0064850 | A1* | 3/2009 | Lengeling | G10H 1/20 84/634 |
| 2013/0298750 | A1* | 11/2013 | Kira | G10H 1/26 84/613 |

* cited by examiner

*Primary Examiner* — Marlon Fletcher
(74) *Attorney, Agent, or Firm* — Ashkon Cyrus; Select Patents

(57) ABSTRACT

In the present invention, a user is capable of choosing manually or automatically a point on a chosen keyboard where a division will occur. For musical/artistic reasons, this point must regularly change. To accommodate this need, the user can store that location in an existing preset/restore system and recall it upon demand with other settings.

7 Claims, 2 Drawing Sheets

AUTOMATICALLY ADJUSTING KEYBOARD DIVIDE

FIELD OF THE INVENTION

The present invention relates to musical instruments, and, more specifically, an automatically adjusting keyboard divider.

BACKGROUND

Skilled organ keyboard players spend a great deal of time setting the divide point of pedal divide units. The pedal divide enables a keyboard player to split the pedal board into a base line of a lower portion and a melody of the upper portion of the pedal board. During an orchestral transcription, many changes to the exact divide point may be required during the scope of one piece of music.

The ability to divide a keyboard or pedalboard has existed for over 100 years, but with electronic relay systems the ability to change where the divide point occurs has been added. Most commonly, a selector knob in a drawer allows the keyboard player to choose the divide point. This keyboard allows the two feet of an organist to play two separate sounds. Traditionally, the "divide point" (the point where the transition occurs) was typically fixed by hardwired multi-gang electrical switches. This "divide point" could not be changed and was a major musical and creative limiting factor.

Other methods of setting the divide point are confusing and inconvenient. These methods include but are not limited to a dial in a drawer, a complex menu system, and interacting with a PC screen.

What is needed is a system where an artist can just turn on and play a keyboard such as an organ keyboard without having to set a divide point.

BRIEF SUMMARY OF THE INVENTION

Embodiments of the present disclosure are directed at an automatically adjusting keyboard divider.

In the present invention, hardware and software are provided that free an operator of a musical instrument containing a keyboard (such as an organ) from having to define the divide point of the keyboard. In one embodiment, the keyboard is a pedal keyboard. However, the present invention is not limited to a pedal keyboard. The software analyzes the playing of a keyboard (so far a keyboard played with the feet (known as a pedalboard) but could be one played by hands (known as a manual) and determines a logical "split point" so that the individual hands/feet play separate sounds without the user providing any input (directing the location of the split).

The present disclosure provides routines, using a combination of Boolean logic, timers, counters, probability and bit addresses, to determine which notes that are being seen are being played by which feet. Specific implementations are provided for regularly occurring circumstances (to account for feet playing closely together, one foot releasing while the other continues, and other regular occurring circumstances).

The user has the option to use pre-defined split points or to allow the detection part of the invention to assign the split points.

BRIEF DESCRIPTION OF THE DRAWINGS

The foregoing and other objects, features, and advantages of the inventions herein, as well as the inventions themselves, will be more fully understood from the following description of various embodiments, when read together with the accompanying drawings, in which.

DETAILED DESCRIPTION

Embodiments of the disclosed subject matter provide techniques for automatically adjusting a keyboard divider. One of the objects of this feature is to provide a system where an artist can just turn on an organ and play it without having to set a divide point.

An embodiment of the present disclosure provides a software process where a local processor/controller within a musical instrument is capable of analyzing incoming data upon demand, musically deciding where a split should occur, and storing that data for later recall at the user's discretion.

Another embodiment allows a user of a musical instrument to choose (either manually or automatically) a divide point on a chosen keyboard where a division will occur. A selector button or knob allows the user to choose between manual and automatic mode. The user can store the location of the divide point in an existing preset/restore system and recall it upon demand with other settings.

Figure 1:
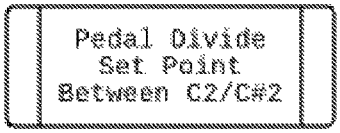
FIG. 1 represents a user interface that allows a keyboard player to see a divide point.

FIG. 1 represents a graphical user interface that allows the user to see the divide point that has been set by the note names. In the case of FIG. 1, the divide point has been set between C2 and C#2.

The user interface allows the user to verify the work of automatic detection routines provided in this disclosure, and view the values recalled by presets. The screen may or may not be a dedicated physical screen and could include virtual interfaces through smart phones, tablets, computers. The user interface may be located on the instrument.

Figure 2:
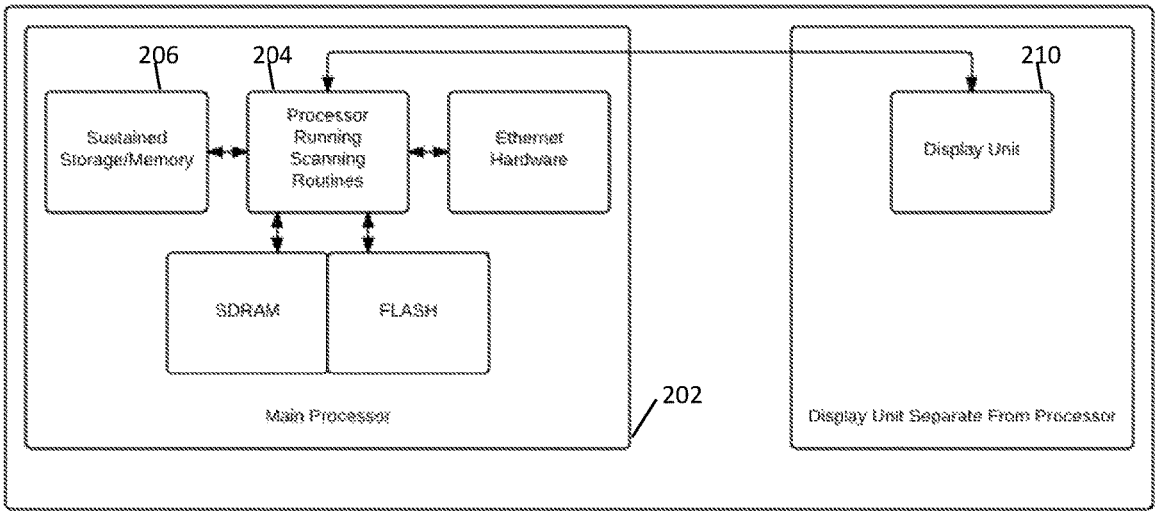
FIG. 2 represents a hardware block diagram.

FIG. 2 illustrates an exemplary embodiment of a system for implementing an automatically adjusting pipe organ keyboard divider. Main Processor 202 comprises a circuit board or combination of circuit boards within a musical instrument. Main Processor 202 is responsible for all relevant software functions. In exemplary embodiments, in terms of hardware architecture, as shown in FIG. 2, Main Processor 202 includes a processor 204 running scanning routines, sustained storage/memory 206 coupled to processor 204, and Ethernet Hardware, SDRAM, and FLASH that are communicatively coupled processor 204. Main processor 202 may have additional elements, which are omitted for simplicity, such as controllers, buffers (caches), drivers, repeaters, and receivers, to enable communications. Further, the local interface may include address, control, and/or data connections to enable appropriate communications among the aforementioned components. FIG. 2 further illustrates a display unit 210 that provides the user interface disclosed in FIG. 1. The display unit is separate from Main Processor 202.

Figure 3:
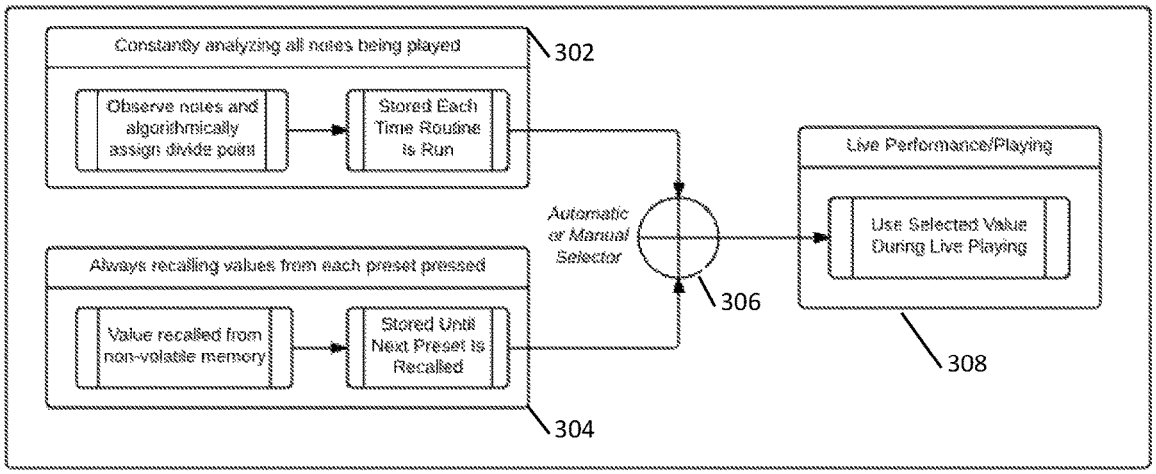
FIG. 3 is a flow chart representative of the mode selection and how mode selection affects the result.

FIG. 3 is a flow chart representative of the mode selection and how mode selection affects the result. The figure illustrates the various components of the software and the end result of the implementation. At block 302, a software routine analyzes the held keys on a pedalboard, follows a logic tree and creates a divide point (also known as a split point). This split point is at a location that ensures that each foot does not "play out of" the zone it is playing in and cross into the other side. The split point is adjusted each time the routine is refreshed and re-calculated.

In one embodiment, the divide point is set by a routine which includes determining a lowest held note and a highest held note. A lowest_held_note function crawls through an array (one bit at a time) from bottom to top and returns the address of the lowest active bit. A highest_held_note function crawls through an array (one bit at a time) from top to bottom and returns the address of the highest active bit. If only one note is held, the functions will return the same result, disqualifying the need for a split point.

If both feet are playing close together, then the divide point should be closer to whichever foot is the root calc value. There are a number of ways to determine this value. In one embodiment, the system detects two feet and measures down from the top foot. For example, if the user is playing with two feet and the highest_held_note is greater than 13, then the divide point is set as the highest_held_note−4, otherwise the divide point is set as the highest_held_note−3.

In a further embodiment, the system detects two feet and measures up from the bottom one. For example, if the user is playing with two feet and the highest_held_note−lowest_held_note is less than 7, then the divide point is set at the lowest_held_note+2.

Three parameters passed to the routine: enable (allow or disallow changes), a timer byte, and the byte value representing the actual divide point.

In one embodiment, the code below runs in an 8 bit operating system. In one embodiment, the language is JAL (Pascal Derivative), and this code is also ported to Oberon (a 16 bit higher level Pascal Derivative). The code is run in a real time control system, so it is run every x milliseconds (typically 8-10) when the keyboard is "scanned".

In one embodiment, if one of the hands/feet stops playing and the other continues, the software freezes the dividing point and does not move it unless the remaining hand/foot begins to approach it, then it moves it, but no further than the "legacy" position. In another embodiment, the split point calculation is only ever performed if two feet are believed to be depressed. In yet another embodiment, the actual split point calculation method is dependent on a constant known as reachability. In one embodiment, reachability is determined by far a foot's heel-toe can reach in a pedalboard. In another embodiment, reachability is determined by how far a thumb-finger can reach in a keyboard.

In one embodiment, the lowest held note is added to reachability to determine the split point. In another embodiment, reachability is subtracted from the highest held note to determine the split point. In another embodiment, the center point between the highest and lowest held notes determines the split point. In yet another embodiment, the split point is centered in the middle of the unused notes between the playing notes.

In one embodiment, there is a diminishing value being subtracted to create the split point. This is typically made fairly generous because of the reach one person can make with one foot between two notes. For example, by holding one note with their heel and pressing another with the tip of their toes, a user can span a surprising distance, the system needs to accommodate for this large distance without classifying it as two feet.

At block 304, a software routine is constantly recalling values from each present. That is, when a preset is recalled, the system takes the saved pedal divide value and puts it into a byte that is reserved just for this purpose. This value is stored until the next preset is recalled.

Block 306 discloses an automatic or manual selector. If the selector is in manual, the system will use the reserved byte. If the selector is in auto, the system will ignore the byte (but not change it). When a preset is saved, the selector is ignored—whatever is currently the playing value is saved.

Additionally, when the user saves the current overall preset (known in the industry as "setting a piston"), if the selector is set to automatic, the automatic divide point is copied with the rest of the settings to non-volatile memory. This ensures that during performance playback, if the divide mode is set to manual then a known setting from a rehearsal can be used. When the user recalls that setting at a later time, if the selector is in manual mode, the known correct divide point is then recalled and copied into non-volatile memory. At block 308, the selected value is used during live playing.

Figure 4:
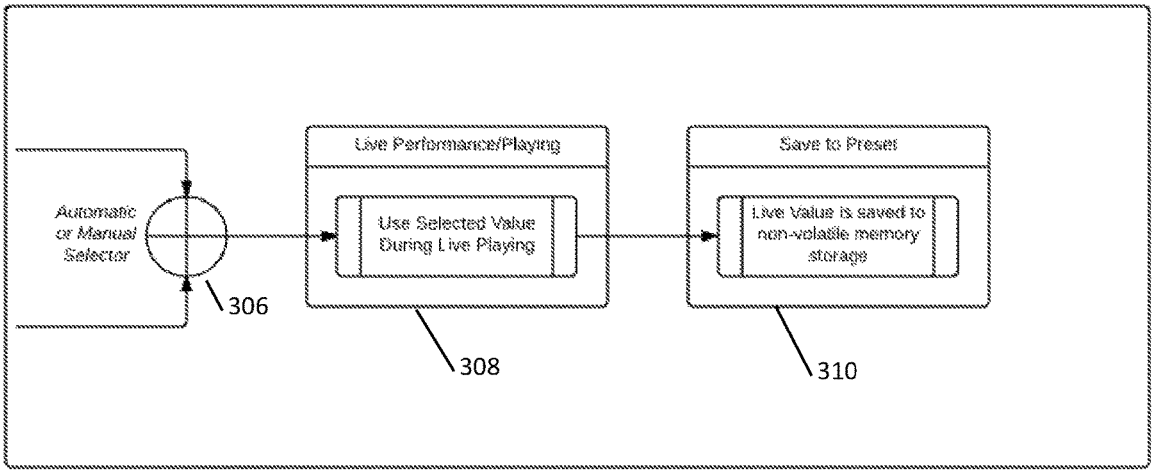
FIG. 4 illustrates that the value saved to a preset is the same value used in live playing.

FIG. 4 illustrates a continuation of the flowchart of FIG. 3 and further illustrates that at block 310, the live value is saved to non-volatile memory storage. The value saved to a preset is the same value used in live playing. If the instrument is in automatic detection mode, the automatically detected value is saved and if the instrument is in manual mode, the manually set mode is saved.

The capabilities of the present invention can be implemented in software, firmware, hardware or some combination thereof.

As one example, one or more aspects of the present invention can be included in an article of manufacture (e.g., one or more computer program products) having, for instance, computer usable media. The media has embodied therein, for instance, computer readable program code means for providing and facilitating the capabilities of the present invention. The article of manufacture can be included as a part of a computer system or sold separately.

Additionally, at least one program storage device readable by a machine, tangibly embodying at least one program of instructions executable by the machine to perform the capabilities of the present invention can be provided.

The flow diagrams depicted herein are just examples. There may be many variations to these diagrams or the steps (or operations) described therein without departing from the spirit of the invention. For instance, the steps may be performed in a differing order, or steps may be added, deleted or modified. All of these variations are considered a part of the claimed invention.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

The invention claimed is:

1. A method comprising:

receiving, from a controller in communication with at least one processor, incoming note data input on demand from a musical instrument;

generating a split point of the musical instrument, wherein the split point is generated by a routine which includes determining an address of a lowest held note and a highest held note by crawling through an array from bottom to top to determine the address of the lowest active note and crawling through an array from top to bottom to determine the address of the highest active note;

providing a selector which can be set to either automatic or manual mode;

storing, by the at least one processor, a routine corresponding to the incoming note data input;

recalling, from non-volatile memory, values from each preset pressed, wherein each value is stored until the next preset is recalled, and using the selected value in a current overall preset during a live playing.

2. The method of claim 1, further comprising storing the saved divide point into a reserved byte.

3. The method of claim 2, further comprising using the reserved byte if the selector is in manual and ignoring the byte if the selector is in auto.

4. The method of claim 2, further comprising saving the current overall preset and the automatic divide point to non-volatile memory.

5. The method of claim 4, wherein if the selector is set to manual, the known correct divide point is then recalled and copied into volatile memory.

6. The method of claim 4, wherein the value saved to the current overall preset is the same value used in live playing.

7. The method of claim 6, wherein the musical instrument is an organ keyboard.

* * * * *